United States Patent [19]

Churley

[11] 4,086,938

[45] May 2, 1978

[54] DOOR AND DRAIN CONTROL INTERLOCK

[75] Inventor: George Churley, Troy, Ohio

[73] Assignee: Hobart Corporation, Troy, Ohio

[21] Appl. No.: 739,445

[22] Filed: Nov. 8, 1976

[51] Int. Cl.[2] ..... B08B 3/02

[52] U.S. Cl. ..... 137/586; 134/57 DL; 251/144

[58] Field of Search ... 134/56 D, 56 R, 57 DL–58 DL, 134/143, 155, 183, 186, 191, 200–201, 57 D–58 D; 137/585–586; 251/144; 312/228–229, 312; 4/198–201, 204; 222/510

[56] References Cited

U.S. PATENT DOCUMENTS

| | | | |
|---|---|---|---|
| 1,559,727 | 11/1925 | Merseles et al. | 134/186 UX |
| 1,833,150 | 11/1931 | Beechlyn et al. | 137/585 X |
| 2,671,455 | 3/1954 | MacDonald et al. | 134/57 DL |
| 2,722,941 | 11/1955 | Bartlett | 134/56 D X |

*Primary Examiner*—Robert L. Bleutge

*Attorney, Agent, or Firm*—Biebel, French & Nauman

[57] ABSTRACT

A dishwasher has a cabinet which defines a cavity, an access opening into the cavity, and a door for said opening. A washing fluid reservoir in the cabinet beneath the cavity holds washing fluid for the dishwasher. A drain for the washing fluid reservoir is manually operable between open and closed conditions when the door is open. The drain is also interlocked with a door on the cabinet which covers the access opening such that when the door is closed, the drain, if previously open, is automatically moved to its closed condition to ready the reservoir for filling. Thus, attempting to fill the reservoir with the drain open will be effectively prevented.

3 Claims, 4 Drawing Figures

DOOR AND DRAIN CONTROL INTERLOCK

BACKGROUND OF THE INVENTION

The present invention relates to dishwashers and, more particularly, to an interlock mechanism for a dishwasher which will automatically close the wash reservoir drain when the dishwasher door is closed.

The present invention relates to dishwashers of the type shown in U.S. Pat. No. 3,911,943, issued Oct. 14, 1975, to Athey el at and assigned to the assignee of the present invention. This type of dishwasher is used generally in a commmercial environment, such as a restaurant, in which a relatively large number of dishes or other items are to be washed. The dishwasher cabinet defines an internal chamber into which racks of the items to be cleaned are placed. The lower portion of the chamber defines a reservoir into which washing fluid containing a detergent or other cleaning agent is loaded before a washing operation is begun. The dishwasher further includes a pump and spray arrangement which pumps the washing fluid out of the reservoir and sprays it onto the dishes. The washing fluid is then collected in the reservoir. This washing fluid may be used to wash a number of loads of dishes before the reservoir is drained and charged with fresh washing fluid.

During the rinse cycle, fresh water is sprayed onto the dishes by a separate rinse spray arrangement and then collects in the reservoir. A standpipe in the reservoir cooperates with the reservoir drain to insure that the fluid level in the reservoir does not exceed a predetermined level. The standpipe normally covers the drain opening in the bottom of the reservoir but may be raised to pemit the reservoir to be drained completely.

The dishwasher disclosed in the Athey et al patent has a lever mounted on the exterior of the cabinet by which the standpipe may be moved into and out of engagement with the reservoir drain. If the dishwasher operator should forget to move the standpipe into its lower position and thus effectively close the reservoir drain prior to charging the reservoir with washing fluid, the washing fluid added to the reservoir would simply flow out the reservoir drain and no fluid would be available for washing the dishes.

One approach taken to solving this problem is shown in patent application Ser. No. 739,443 filed on even date herewith by Focht, assigned to the present assignee and filed on even date herewith. The present application is directed to improvement on the invention of Focht.

SUMMARY OF THE INVENTION

A dishwasher has a cabinet which defines a cavity into which items to be cleaned are placed and an access opening into the cavity. A closure means is provided for covering the access opening and a washing fluid reservoir is defined in the cabinet beneath the cavity. A standpipe mechanism in the reservoir is movable from an upper position in which a drain in the bottom of the reservoir is opened to a closed, lower position in which the fluid level in the reservoir is maintained at an operating level. A linearly actuatable linkage means is connected to the standpipe mechanism such that it can be moved between opened and closed positions. Pivotal linkage means is responsive to the closure means covering the access opening to move the linearly actuatable linkage means such that the standpipe is moved into its closed lowered position, thereby preventing the reservoir from being inadvertently drained.

The pivotal linkage means may be pivotally attached to the cabinet and pivotable from a first position in which the linearly actuatable linkage means is moved to an overcenter position and the standpipe mechanism is held in its upper position.

Accordingly, it is an object of the present invention to provide an improved dishwasher having a drain control mechanism in which the dishwasher door bears upon a camming surface as it is closed, and thereby closes the reservoir drain; to provide such a dishwasher in which a linearly actuatable link is attached between the camming surface and the drain mechanism; and, further, to provide such a mechanism in which a simple, lost motion linkage arrangement permits the door to be opened without affecting the drain.

Other objects and advantages of the present invention will be apparent from the following description, the accompanying drawings, and the appended claims.

DETAILED DESCRIPTION OF THE PREFERRED EMBODIMENT

Figure 1:
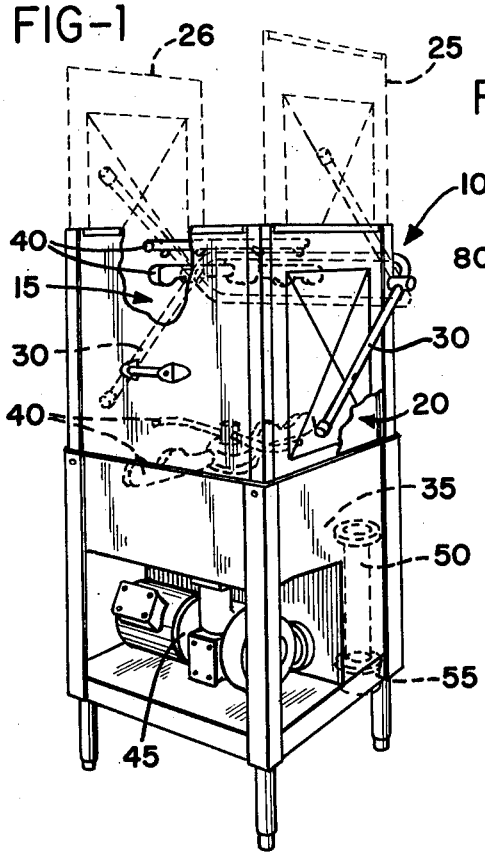
FIG. 1 is a perspective view of the dishwasher of the present invention with portions broken away and with the door closure mechanism shown in both open and closed positions.

Referring to FIG. 1, there is shown a perspective view of the dishwasher of the present invention. A cabinet 10 defines an interior cavity or washing chamber 15 into which items are placed to be cleaned. Cabinet 10 also defines one or more access openings 20 which may be covered by a closure means such as door 25. The cabinet shown in FIG. 1 is of the type used in a flow-through washing operation in which articles are inserted through one opening into the washing cavity and, after washing, are removed through a second opening. Door 26 is provided for removal of washed items and is linked to a door 25 by means of a pivoting handle mechanism 30. When either end of handle mechanism 30 is lifted, doors 25 and 26 will be raised into the position shown by the dash lines.

A washing fluid reservoir or sump 35 is provided in the bottom of the dishwasher. Washing and rinsing apparatus of standard configuration is provided to spray wash fluid and rinse fluid during the washing process. The fluid collects in the wash fluid reservoir 35 and is pumped by pump 45 which acts as a means for recirculating the wash fluid from the sump through the spray system 40. During the rinse process, clean rinse water is sprayed through spray system 40 onto the washed items. The rinse water also collects in the sump.

A standpipe mechanism 50 in reservoir 35 is provided in order to prevent excess fluid from accumulating in the reservoir during the rinse cycle. The standpipe 50 communicates with a drain means 55 and acts as a drain closure means.

Figure 3:
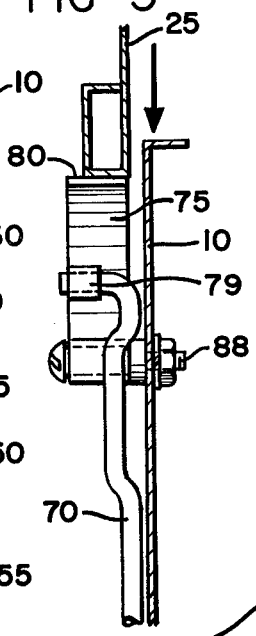
FIG. 3 is a partial sectional view of the upper portion of the interlock as seen looking generally right to left in FIG. 2.
Figure 2:
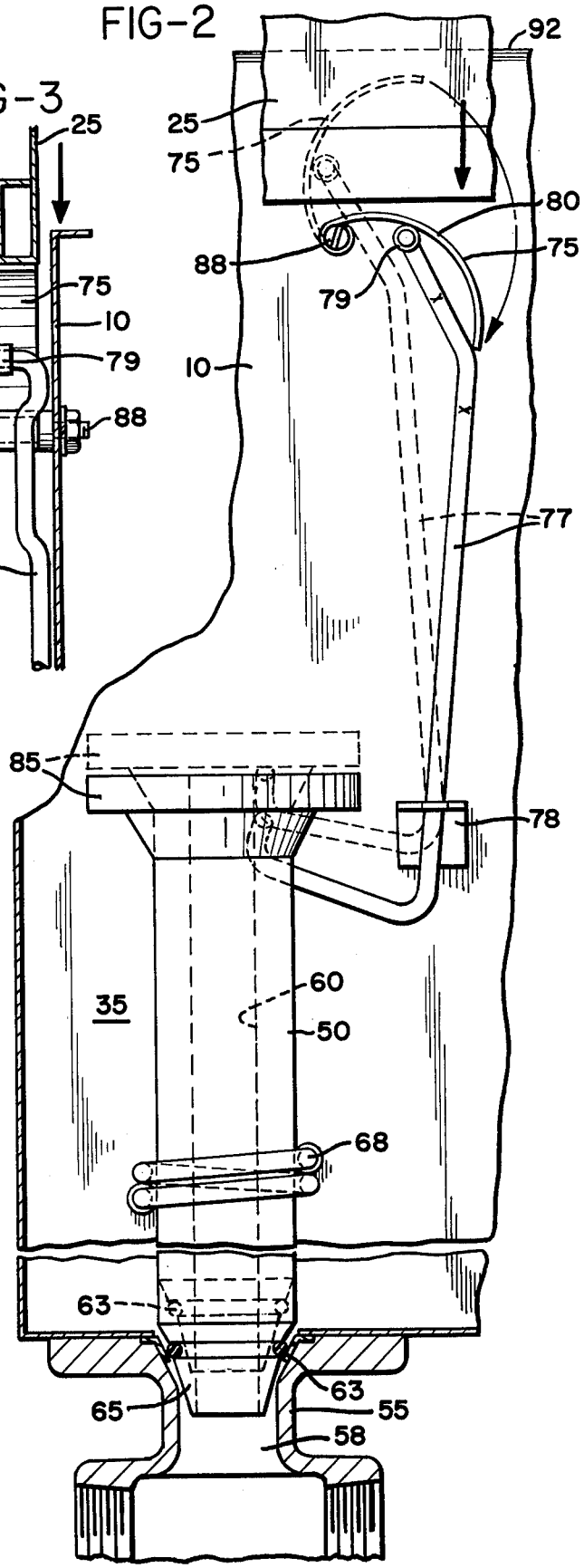
FIG. 2 is a partial sectional view through the drain mechanism as seen looking generally left to right in FIG. 1.
Figure 4:
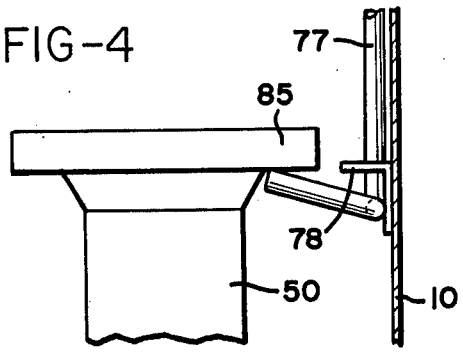
FIG. 4 is a partial sectional view showing the lower portion of the interlock, as seen looking right to left in FIG. 2.

Referring to FIGS. 2 through 4, the standpipe 50, drain 55, and an interlock means are shown in greater detail. The interlock means is responsive to the closing of the door mechanism to close the drain means and to prevent draining of the reservoir. Drain means 55 defines a drain opening 58 which communicates with standpipe mechanism 50. Standpipe mechanism 50 is moveable between a first, lower position, shown by the solid lines, in which the standpipe 50 closes the drain opening 58 and a second upper position in which the opening 58 is opened. When the standpipe mechanism is in its first, lower position, fluid in the sump can flow out through drain means 55 only by flowing over the top of the standpipe mechanism and down through opening 60. As seen in FIG. 2, rubber seal 63 encircles the frustoconical portion 65 of standpipe mechanism 50 and insures a watertight seal. Wire loop 68 is fastened to the inside of cabinet 10 and holds standpipe mechanism 50 in position above drain means 55 while permitting the standpipe mechanism to move vertically.

The interlock means which is responsive to the closing of the door includes a linearly actuatable linkage means comprising first pivotal linkage means 75 and second linearly actuatable linkage 77. Linkage 77 extends through an opening in stationary bracket 78 and may be moved vertically as shown by the dash lines in FIG. 2. As seen in FIG. 4, the lower end of linkage 77 is positioned directly beneath the lip 85 of standpipe mechanism 50 which acts as a means for engaging the standpipe mechanism 50. Upward movement of linkage means 77 results in the standpipe mechanism being moved into its second upper position in which the drain opening 58 is open to drain sump 35 completely. After the linkage means 77 is lowered, the standpipe mechanism 50 is moved into its first, closed position in which only overflow fluid will pass out through drain 55.

Linkage means 77 is pivotally attached through a loop 79 to pivotal linkage means 75 which defines an upper cam surface 80. Linkage means 75 is fastened to cabinet 10 and pivots about a bolt 88 in a lost motion cooperative relationship with door 25. When linkage means 75 is in its upper position, as shown by dashed lines in FIG. 2, an overcenter type of action will hold linkage means 77 in its raised position, consequently opening drain 55. Since linkage means 75 is positioned just below the bottom edge 92 of access opening 20, when door 25 is opened, the operator merely reaches into cavity 20 in order to move pivotal means 75 and open drain 55. The interlock is, therefore, effectively a manually operable latch means for latching the drain into an open position.

In order to insure that the drain opening 58 is closed at the beginning of each washing cycle, a lost motion interaction between the door 25 and linkage means 75 is provided, as illustrated in FIG. 3. As door 25 is lowered, it comes in contact with the curved upper camming surface of linkage means 75 and pivots linkage means 75 back over center about bolt 88 thus acting as a latch release. The door then descends into the position shown in FIG. 2, and the linkage means drops downward permitting drain 55 to close. The lost motion interaction between the door 25 and linkage means 75 permits the door to be opened between washing operations for loading and unloading cavity 15 without requiring the sump to be recharged with washing fluid after each such opening. To raise the standpipe, with the door open, the operator merely reaches through the opening and lifts the linkage 75 to the upper over center position.

While the form of apparatus herein described constitutes a preferred embodiment of the invention, it is to be understood that the invention is not limited to this precise form of apparatus and that changes may be made therein without departing from the scope of the invention.

What is claimed is:

1. In a dishwasher including:

a cabinet defining a cavity into which items to be cleaned are placed and an access opening into said cavity, a closure means for covering said opening, a washing fluid reservoir in said cabinet beneath said cavity, a standpipe mechanism in said reservoir which is movable from an upper position in which a drain in the bottom of said reservoir is opened to a closed, lower position in which the fluid level in said reservoir is maintained at an operating level, the improvement comprising:

linearly actuatable linkage means for moving said standpipe mechanism between said opened and closed positions, and pivotal linkage means, responsive to said closure means covering said access opening, for moving said linearly actuatable linkage means such that said standpipe mechanism is moved into its closed lower position, whereby said washing fluid reservoir will not be inadvertently drained, said pivotal linkage means being operable to move said standpipe mechanism to the open position only when said closure means is open and independently of movement of said closure means.

2. The dishwasher of claim 1 in which said pivotal linkage means is pivotally attached to the interior of said cabinet and is pivotable from a first position to a second position and in which said linearly actuatable linkage means is pivotally attached to said pivotal linkage means such that said linearly actuatable linkage means is moved to an overcenter position in which said standpipe mechanism is held in its said upper position when said pivotal linkage means is in its first position.

3. In a dishwasher having a cabinet defining in its upper portion a washing chamber and defining in its lower portion a fluid reservoir, an access opening in said cabinet communicating with said washing chamber, door means mounted to slide from an upper position in which said access opening is exposed into a lower position in which said access opening is covered, a drain in said fluid reservoir, drain closure means having an upper position in which said reservoir is drained and a lower position, and a drain latch mechanism for positioning said drain closure means in said upper or lower positions, an improvement in said drain latch mechanism comprising:

a first link having an upper cam surface and pivotally attached at one end to the interior of said cabinet, said first link being movable between an upper position and a lower position, the upper position of said link being such that as said door slides downwardly to close said access opening, said door will contact said camming surface of said first link and cause said first link to pivot toward its said lower position, a second link pivotally attached to said first link and movable between an upper position in which said second link is held over-center by said first link to a lower position in which said second link is contacted by the end of said first link opposite the end at which said first link is attached to the cabinet such that said second link does not drop below said lower position, and means for engaging said second link on said drain closure means such that said drain closure means is moved upwardly when said first and second links are moved upwardly and for permitting said drain closure means to close as said door is lowered onto said cam surface of said first link.

* * * * *